US009200606B2

(12) United States Patent
Kim et al.

(10) Patent No.: US 9,200,606 B2
(45) **Date of Patent: *Dec. 1, 2015**

(54) ELECTRONICALLY CONTROLLED FUEL INJECTION VALVE

(75) Inventors: Dong-Hun Kim, Ulsan (KR); Seung-Hyup Ryu, Ulsan (KR); Tae-Hyung Park, Ulsan (KR)

(73) Assignee: HYUNDAI HEAVY INDUSTRIES, CO., LTD., Ulsan (KR)

( * ) Notice: Subject to any disclaimer, the term of this patent is extended or adjusted under 35 U.S.C. 154(b) by 219 days.

This patent is subject to a terminal disclaimer.

(21) Appl. No.: 13/997,754

(22) PCT Filed: Dec. 26, 2011

(86) PCT No.: PCT/KR2011/010120

§ 371 (c)(1),
(2), (4) Date: Jul. 25, 2013

(87) PCT Pub. No.: WO2012/091393

PCT Pub. Date: Jul. 5, 2012

(65) Prior Publication Data

US 2013/0298877 A1 Nov. 14, 2013

(30) Foreign Application Priority Data

Dec. 28, 2010 (KR) ..... 10-2010-0136404
Dec. 28, 2010 (KR) ..... 10-2010-0136406

(51) Int. Cl.

| | |
|---|---|
| ***F02M 51/00*** | (2006.01) |
| ***F02M 61/10*** | (2006.01) |
| ***F02M 51/06*** | (2006.01) |
| ***F02M 61/16*** | (2006.01) |
| ***F02M 47/02*** | (2006.01) |
| ***F02M 63/00*** | (2006.01) |

(52) U.S. Cl.

CPC ..... *F02M 61/10* (2013.01); *F02M 47/027* (2013.01); *F02M 51/06* (2013.01); *F02M 61/16* (2013.01); *F02M 63/0005* (2013.01); *F02M 63/0007* (2013.01); *F02M 63/0029* (2013.01)

(58) Field of Classification Search

CPC ..... F02M 61/10; F02M 51/0671
USPC ..... 123/490; 239/584, 585.1, 585.5
See application file for complete search history.

(56) References Cited

U.S. PATENT DOCUMENTS 5,385,301 A * 1/1995 Ueda ..... 239/88
5,524,825 A * 6/1996 Ueda ..... 239/88
5,988,533 A 11/1999 Augustin (Continued)

FOREIGN PATENT DOCUMENTS

JP 07-324665 A 12/1995
JP 10-131828 A 5/1998

(Continued)

OTHER PUBLICATIONS

International Search Report of PCT/KR2011/010120, Mailed on Jun. 25, 2013.

*Primary Examiner* — John Kwon
(74) *Attorney, Agent, or Firm* — Rabin & Berdo, P.C.

(57) ABSTRACT

An electronically controlled fuel injection valve can independently control the time to inject fuel and the amount of fuel to be injected in response to a control signal sent from the operating condition of an engine unlike a traditional mechanical fuel injection valve, and employs a control method for fuel injection that increases the force of lifting up a cutoff needle of an injection controller by delivering high-pressure fuel to a lower pressure chamber via a control needle, thereby rapidly controlling fuel injection. The electronically controlled fuel injection valve prevents a nozzle part from being constantly subjected to high pressure due to the nozzle part being not supplied with fuel when fuel is not injected, prevents a large amount of fuel from leaking into a combustion chamber when a part such as a needle is damaged, and simplifies the structure of a second flow path, thereby facilitating fabrication.

5 Claims, 12 Drawing Sheets

(56) References Cited

U.S. PATENT DOCUMENTS

| | | | | |
|---|---|---|---|---|
| 6,161,773 | A | 12/2000 | Camplin et al. | |
| 2013/0332048 | A1* | 12/2013 | Kim et al. | 701/103 |

FOREIGN PATENT DOCUMENTS

| | | | |
|---|---|---|---|
| JP | 2000-087821 | A | 3/2000 |
| JP | 2010-249103 | A | 11/2010 |

* cited by examiner

ELECTRONICALLY CONTROLLED FUEL INJECTION VALVE

TECHNICAL FIELD

The present invention relates, in general, to an electronically controlled fuel injection valve and, more particularly, to an electronically controlled fuel injection valve which can independently control the time to inject fuel and the amount of fuel to be injected in response to a control signal sent from the operating condition of an engine, and when fuel is not injected, prevent a nozzle part from being constantly subjected to high pressure due to the nozzle part being not supplied with fuel.

BACKGROUND ART

In response to the development of electronic control technologies, it is the rapidly-growing trend to electronically control engines. Fuel injection methods using a common rail are being widely applied to electronically controlled engines since fuel injection can be performed under high pressure even with a low load and can be easily performed in response to a control signal.

A variety of research and development is being performed on electronically controlled fuel injection valves that are key devices of common rail fuel injection systems. In order to improve the performance of the fuel injection valve, a large number of patent applications are being filed for various types of fuel injection valve driving mechanisms.

A traditional mechanical fuel injection valve is configured such that fuel is injected by lifting up a needle using only the pressure of fuel that is fed into a chamber of a nozzle part. Since injection characteristics such as the time to inject fuel and the amount of fuel to be injected are always uniform, control over fuel injection cannot be performed independently from the operating condition of an engine and this can be problematic.

In addition, in the case of a traditional electronically controlled fuel injection valve, fuel is constantly supplied to the nozzle part through a fuel supply port and the nozzle part is constantly subjected to high pressure. Consequently, a large amount of fuel leaks into the combustion chamber when accidents, such as damage to the needle of the nozzle or to a valve seat, occur.

DISCLOSURE

Technical Problem

Accordingly, the present invention has been made keeping in mind the above problems occurring in the related art, and is intended to provide an electronically controlled fuel injection valve which can control the time to inject fuel and the amount of fuel to be injected in response to a control signal sent independently from the operating condition of an engine unlike a traditional mechanical fuel injection valve, and which employs a control method for fuel injection that increases the force of lifting up a cutoff needle of an injection controller by delivering high-pressure fuel to a lower pressure chamber via a control needle, thereby rapidly controlling fuel injection. This invention prevents a nozzle part from being constantly subjected to high pressure due to the nozzle part being not supplied with fuel when fuel is not injected, prevents a large amount of fuel from leaking into a combustion chamber when a part such as a needle is damaged, and simplifies the structure of a second flow path, thereby facilitating fabrication.

Technical Solution

In order to accomplish the above objects, the present invention provides an electronically controlled fuel injection valve that includes: a valve body having defined therein a first flow path along which fuel is fed through a fuel supply port, the valve body having a control valve housing in an upper portion thereof; a nozzle part coupled to a lower portion of the valve body, the nozzle part having defined therein a nozzle chamber which is filled with fuel that is supplied via the first flow path so that a needle disposed therein is pressed upward, whereby the needle is lifted up so that fuel is injected toward a nozzle hole; an injection controller disposed inside the valve body so as to be able to open and close the first flow path in order to control the nozzle part to inject fuel; a nozzle pressing part positioned below the injection controller, the nozzle pressing part applying a downward force to the needle of the nozzle part; an upper pressure chamber formed above the injection controller, the upper pressure chamber creating a pressure when the upper pressure chamber is filled with fuel injected through the fuel supply port, the pressure moving the injection controller downward; a lower pressure chamber positioned below the upper pressure chamber, the lower pressure chamber creating a pressure when the lower pressure chamber is filled up with fuel, the pressure lifting up the injection controller; a cutoff pressure chamber positioned below the lower pressure chamber, the cutoff pressure chamber creating a pressure when the cutoff pressure chamber is filled with fuel that flows through the first flow path, the pressure lifting up the injection controller; a second flow path formed in the valve body via the control valve housing, the second flow path being connected to the lower pressure chamber, thereby allowing fuel to be supplied to the lower pressure chamber; a control needle disposed within the control valve housing, the control needle opening and closing the second flow path in response to a control signal, thereby controlling a flow rate of fuel that is supplied to the lower pressure chamber; a control chamber formed in the valve body so as to be connected to the lower pressure chamber, such that the control chamber is filled with fuel from the lower pressure chamber when fuel is discharged; and a control orifice connected to the control chamber, and the control orifice allowing fuel inside the control chamber to be discharged out of the valve body.

In addition, the injection controller may include: a cutoff part disposed at a center of the valve body, the cutoff part being lifted up by a force under a pressure of fuel that fills the lower pressure chamber and the cutoff pressure chamber so as to open and close the first flow path, thereby controlling supply of fuel to the nozzle part; a pressure piston disposed above the cutoff part, the pressure piston applying a downward force to the cutoff part under a pressure of fuel that fills the upper pressure chamber; and a spring disposed and inserted into the pressure piston, the spring applying a downward force to the cutoff part.

Furthermore, the cutoff part may include: a spindle forced in an upward direction under the pressure of fuel that fills the lower pressure chamber; and a cutoff needle disposed under the spindle so as to be separate from the spindle, wherein the cutoff needle is forced in an upward direction under a pressure of fuel that fills the cutoff pressure chamber, and when actuated upward together with the spindle, opens the first flow path.

In order to accomplish the above objects, the present invention also provides an electronically controlled fuel injection valve that includes: a valve body having defined therein a first flow path along which fuel is fed through a fuel supply port, the valve body having a control valve housing in an upper portion thereof; a nozzle part coupled to a lower portion of the valve body, the nozzle part having defined therein a nozzle chamber which is filled with fuel that is supplied via the first flow path so that a needle disposed therein is pressed upward, whereby the needle is lifted up so that fuel is injected toward a nozzle hole; an injection controller disposed inside the valve body so as to be able to open and close the first flow path in order to control the nozzle part to inject fuel; a nozzle pressing part positioned below the injection controller, the nozzle pressing part applying a downward force to the needle of the nozzle part; an upper pressure chamber formed above the injection controller, the upper pressure chamber creating a pressure when the upper pressure chamber is filled with fuel injected through the fuel supply port, the pressure moving the injection controller downward; a lower pressure chamber positioned below the upper pressure chamber, the lower pressure chamber creating a pressure when the lower pressure chamber is filled up with fuel, the pressure lifting up the injection controller; a cutoff pressure chamber positioned below the lower pressure chamber, the cutoff pressure chamber creating a pressure when the cutoff pressure chamber is filled with fuel that flows through the first flow path, the pressure lifting up the injection controller; a second flow path formed inside the injection controller via the control valve housing, the second flow path being connected to the lower pressure chamber, thereby allowing fuel to be supplied to the lower pressure chamber; a control needle disposed within the control valve housing, the control needle opening and closing the second flow path in response to a control signal, thereby controlling a flow rate of fuel that is supplied to the lower pressure chamber; a control chamber formed in the valve body so as to be connected to the lower pressure chamber, such that the control chamber is filled with fuel from the lower pressure chamber when fuel is discharged; and a control orifice connected to the control chamber, and the control orifice allowing fuel inside the control chamber to be discharged out of the valve body.

In addition, the injection controller may include: a cutoff part disposed so as to be fitted into the control valve housing, the cutoff part being positioned below the upper pressure chamber, and being lifted up by a force caused by a pressure of fuel that fills the lower pressure chamber and the cutoff pressure chamber, thereby opening and closing the cutoff part; and a spring disposed so as to be fitted into the cutoff part, the spring applying a downward force to the cutoff part.

Furthermore, the cutoff part may include: a spindle having an insertion hole into which the control valve housing is insertable and a plurality of connection holes inside the insertion hole, the connecting holes being connected to the lower pressure chamber such that the second flow path formed in the control valve housing is connectable to the lower pressure chamber, the spindle being forced in an upward direction under a pressure of fuel that fills the lower pressure chamber; and a cutoff needle disposed under the spindle so as to be separate from the spindle, wherein the cutoff needle is forced in an upward direction under a pressure of fuel that fills the cutoff pressure chamber, and when actuated upward together with the spindle, opens the first flow path.

In addition, the valve body may further have a fuel drain hole which prevents fuel in the cutoff pressure chamber from leaking to the lower pressure chamber through an interval between the outer circumference of the cutoff needle and the inner circumference of the valve body so that a pressure of leaking fuel does not additionally act on the spindle.

Furthermore, the nozzle pressing part may include: a needle spindle having a concave chamber in an upper portion thereof which can be filled with fuel when the first flow path is opened by the injection controller, the needle spindle being disposed above the needle, and applying a downward force to the needle under a pressure of fuel; and a nozzle spring disposed above the needle spindle, the nozzle spring applying a downward force to the needle spindle.

As described above, the present invention has the following merits. It is possible to control the time to inject fuel and the amount of fuel to be injected in response to a control signal sent independently from the operating condition of an engine, which is unlike a traditional mechanical fuel injection valve. A control method for fuel injection increases the force of lifting up a cutoff needle of an injection controller by delivering high-pressure fuel to a lower pressure chamber via a control needle, thereby rapidly controlling fuel injection.

In addition, the simplified structure facilitates replacement of parts. Since the spindle and the piston are separately fabricated such that surfaces which require precision machining are minimized, it is possible to facilitate precision machining of parts, thereby reducing fabrication cost. It is easy to machine the second flow path by placing the second flow path within the control valve housing. Since the surfaces that require precision machining are minimized, it is possible to facilitate precision machining of parts, thereby reducing fabrication cost.

Furthermore, when fuel is not being injected, the cutoff needle prevents the nozzle part from being constantly subjected to high pressure by cutting off fuel delivery to the nozzle part. This prevents a large amount of fuel from leaking into the combustion chamber when any part malfunctions or is damaged, thereby creating a safer mechanism. It is easy to reduce the size of the spring which presses down the needle of the nozzle part or to increase the pressure at which the nozzle part is opened or closed.

Figure 1:
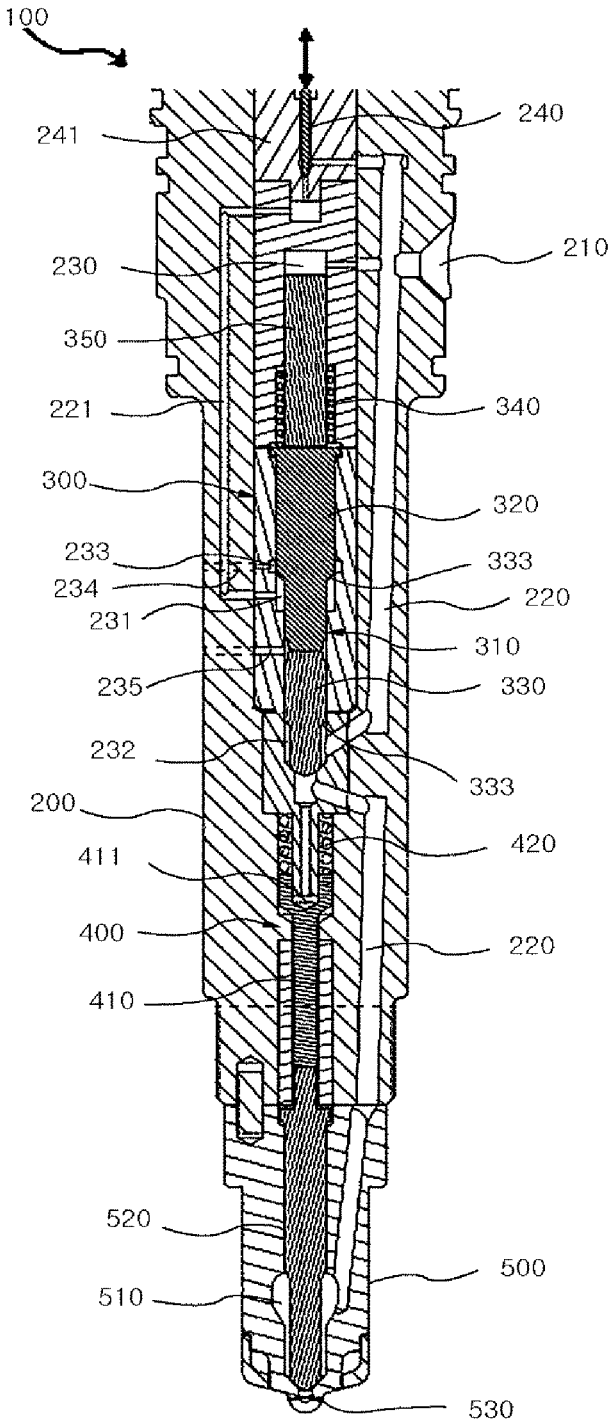
FIG. 1 is an example view showing a fuel injection valve according to a first embodiment of the present invention.

<Description of the Reference Numerals in the Drawings>

| | |
|---|---|
| 100: fuel injection valve | 200: valve body |
| 210: fuel supply port | 220: first flow path |
| 221: second flow path | 230: upper pressure chamber |
| 231: lower pressure chamber | |
| 232: cutoff pressure chamber | |
| 233: control chamber | 234: control orifice |
| 235: fuel drain hole | 240: control needle |
| 241: control valve housing | |
| 300: injection controller | |
| 310: cutoff part | 320: spindle |
| 321: insertion hole | 322: connection hole |
| 330: cutoff needle | 333: pressure acting surface |
| 340: spring | 350: pressure piston |
| 400: nozzle pressing part | 410: needle spindle |
| 411: chamber | 420: nozzle spring |
| 500: nozzle part | 510: nozzle chamber |
| 520: needle | 530: nozzle hole |

MODE FOR INVENTION

Reference will now be made in detail to embodiments of the present invention and their functions in conjunction with the accompanying drawings. In the following description of the present invention, detailed descriptions of known functions and components incorporated herein will be omitted when they may make the subject matter of the present invention unclear.

Figure 2:
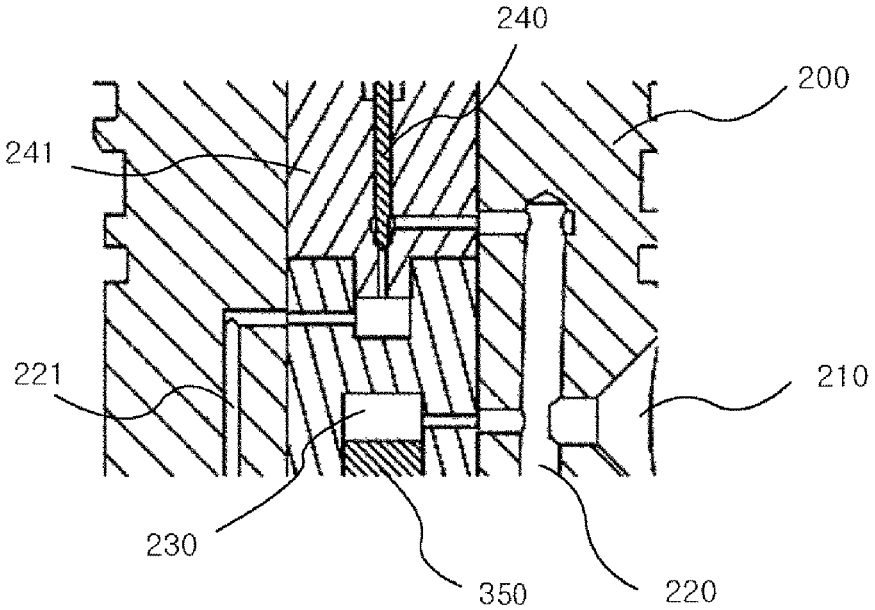
FIG. 2 is an example view specifically showing the installation structure of the control needle of the fuel injection valve according to the first embodiment of the present invention.
Figure 3:
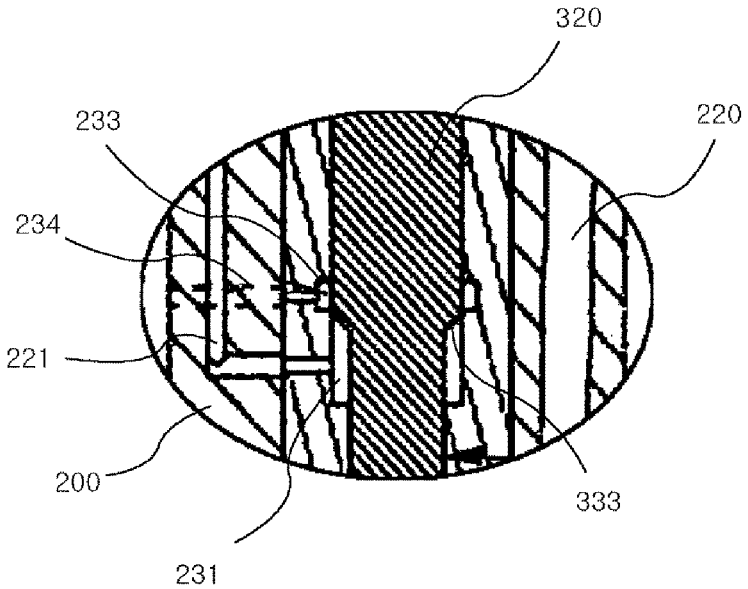
FIG. 3 is an example view specifically showing the structure of the spindle and the lower pressure chamber of the fuel injection valve according to the first embodiment of the present invention.
Figure 4:
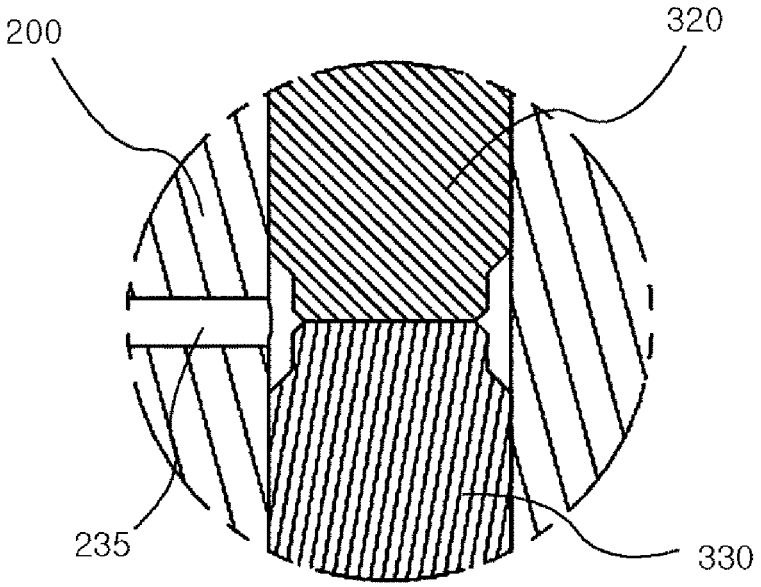
FIG. 4 is an example view showing the fuel drain hole which is formed in the contact area between the spindle and the cutoff needle of the cutoff part according to the first embodiment of the present invention.
Figure 5:
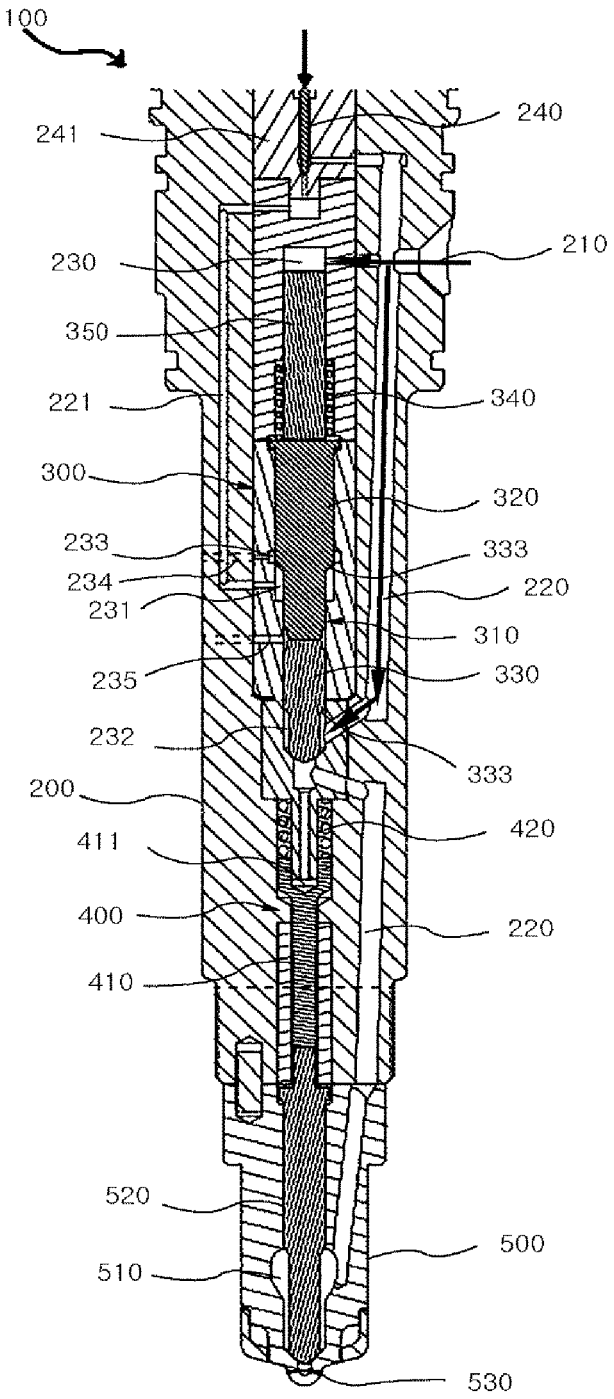
FIG. 5 is an example view showing the operating state and the flow of fuel when fuel is not injected in response to closing of the control needle of the fuel injection valve according to the first embodiment of the present invention.
Figure 6:
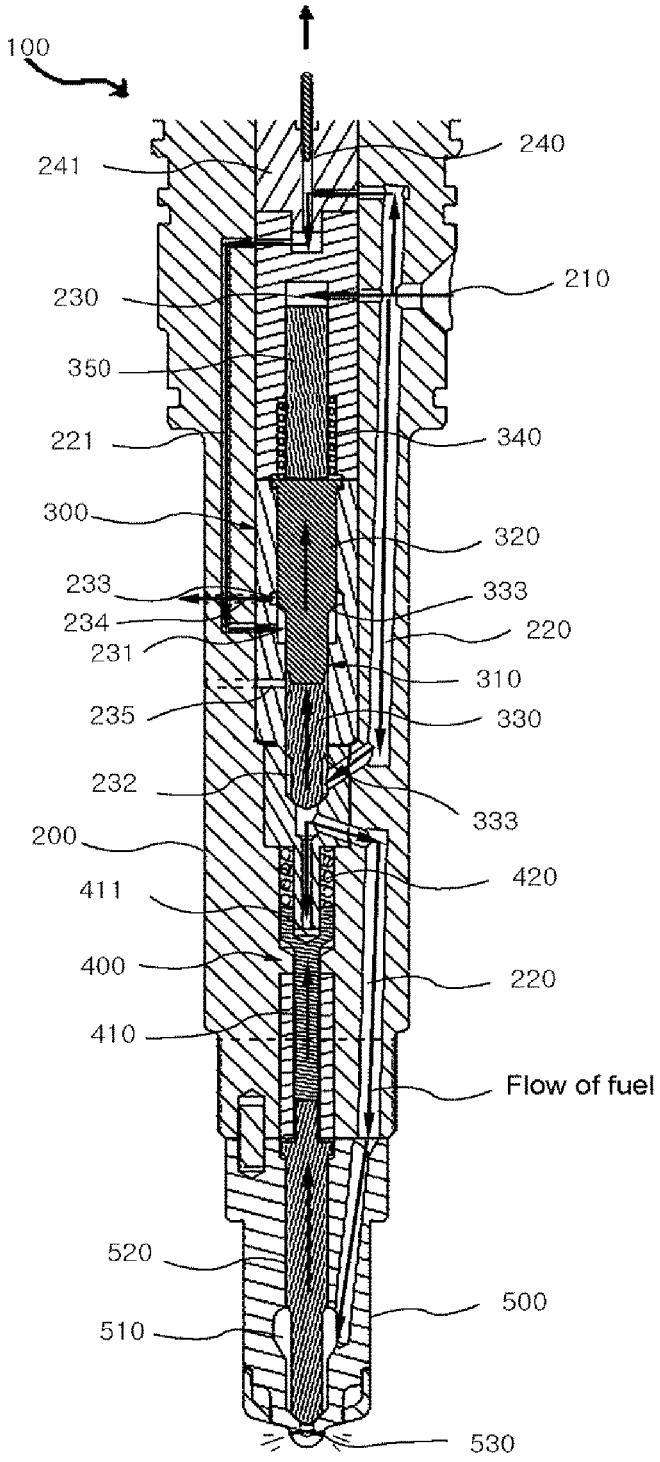
FIG. 6 is an example view showing the operating state and the flow of fuel when fuel is injected in response to opening of the control needle of the fuel injection valve according to the first embodiment of the present invention.
Figure 7:
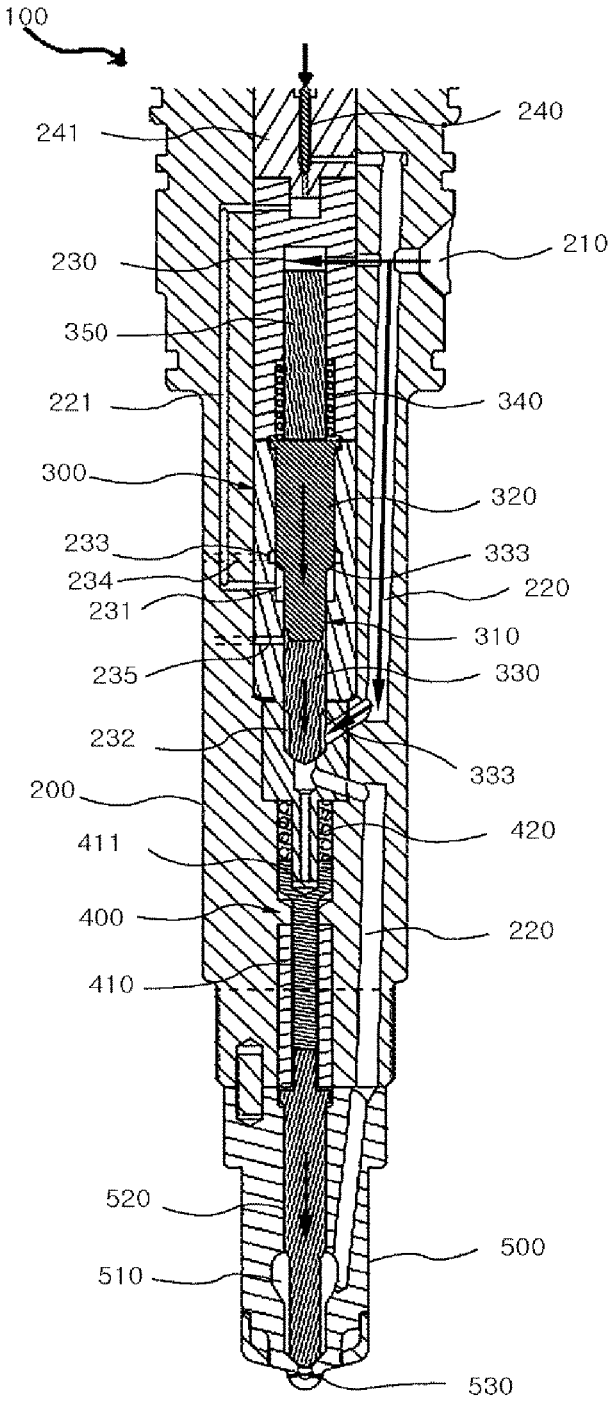
FIG. 7 is an example view showing the operating state and the flow of fuel when fuel injection is completed in response to re-closing of the control needle of the fuel injection valve according to the first embodiment of the present invention.

FIG. 1 is an example view showing a fuel injection valve according to a first embodiment of the present invention, FIG. 2 is an example view specifically showing the installation structure of the control needle of the fuel injection valve according to the first embodiment of the present invention, FIG. 3 is an example view specifically showing the structure of the spindle and the lower pressure chamber of the fuel injection valve according to the first embodiment of the present invention, FIG. 4 is an example view showing the fuel drain hole which is formed in the contact area between the spindle and the cutoff needle of the cutoff part according to the first embodiment of the present invention, FIG. 5 is an example view showing the operating state and the flow of fuel when fuel is not injected in response to closing of the control needle of the fuel injection valve according to the first embodiment of the present invention, FIG. 6 is an example view showing the operating state and the flow of fuel when fuel is injected in response to opening of the control needle of the fuel injection valve according to the first embodiment of the present invention, and FIG. 7 is an example view showing the operating state and the flow of fuel when fuel injection is completed in response to re-closing of the control needle of the fuel injection valve according to the first embodiment of the present invention.

As shown in the figures, according to the present invention, the fuel injection valve 100 includes a valve body 200, a nozzle part 500, an injection controller 300, a nozzle pressing part 400, an upper pressure chamber 230, a lower pressure chamber 231, a cutoff pressure chamber 232, a second flow path 221, a control needle 240, a control chamber 233 and a control orifice 234. The valve body 200 has defined therein a first flow path 220 along which fuel is fed through a fuel supply port 210, and has a control valve housing 241 in the upper portion thereof. The nozzle part 500 is coupled to the lower portion of the valve body 200, and has defined therein a nozzle chamber 510 which is filled with fuel that is supplied via the first flow path 220 so that a needle 520 disposed therein is pressed upward, whereby the needle 520 is lifted up so that fuel is injected toward a nozzle hole 530. The injection controller 300 is disposed inside the valve body 200 such that it can open and close the first flow path 220 in order to control the nozzle part 500 to inject fuel. The nozzle pressing part 400 is disposed inside the valve body 200, is positioned below the injection controller 300, and applies a downward force to the needle 520 of the nozzle part 500. The upper pressure chamber 230 is formed above the injection controller 300, and creates a pressure when it is filled with fuel fed through the fuel supply port 210, the pressure moving the injection controller 300 downward. The lower pressure chamber 231 is positioned below the upper pressure chamber 230, and creates a pressure when it is filled up with fuel, the pressure lifting up the injection controller 300. The cutoff pressure chamber 232 is positioned below the lower pressure chamber 231, and creates a pressure when it is filled with fuel that flows through the first flow path 220, the pressure lifting up the injection controller 300. The second flow path 221 is formed in the valve body 200 via the control valve housing 241, and is connected to the lower pressure chamber 231. The injection controller 300 allows fuel to be supplied to the lower pressure chamber 231. The control needle 240 is disposed within the control valve housing 241, and opens and closes the second flow path 221 in response to a control signal, thereby controlling the flow rate of fuel that is supplied to the lower pressure chamber 231. The control chamber 233 is formed in the valve body 200 so as to be connected to the lower pressure chamber 231, such that it is filled with fuel from the lower pressure chamber 231 when fuel is discharged. The control orifice 234 is connected to the control chamber 233, and allows fuel inside the control chamber 233 to be discharged out of the valve body 200.

The control needle 240 is configured such that it can be actuated by an actuator (not shown) which operates in response to a control signal so as to open and close the second flow path 221, thereby controlling the flow rate of fuel that flows into the lower pressure chamber 231.

The injection controller 300 includes a cutoff part 310, a pressure piston 350 and a spring 340. The cutoff part 310 is disposed at the center of the valve body 200, and can be lifted up by a force under the pressure of fuel that fills the lower pressure chamber 231 and the cutoff pressure chamber 232 so as to open and close the first flow path 220, thereby controlling the supply of fuel to the nozzle part 500. The pressure piston 310 is disposed above the cutoff part 310, and applies a downward force to the cutoff part 310 under the pressure of fuel that fills the upper pressure chamber 230. The spring 340 is disposed such that it is inserted into the pressure piston 350, and applies a downward force to the cutoff part 310.

In the first embodiment of the present invention, since the cutoff part 310 and the pressure piston 350 are separate, it is easy to adjust the intervals from the outer circumferences of the pressure piston 350 and the cutoff part 310 which require precision machining to the inner circumference of the inner space of the valve body 200 in which they are disposed, thereby facilitating the fabrication of the valve and reducing fabrication cost.

That is, the intervals from the outer circumferences of the pressure piston 350 and the cutoff part 310 to the inner circumference of the inner space of the valve body 200 must be precisely machined to a very small size in order to prevent high-pressure fuel, that fills the inside of the upper pressure chamber 230 and the lower pressure chamber 231, from leaking through the interval. When the cutoff part 310 and the pressure piston are formed integrally, machining is difficult since one part has a large number of surfaces that must be precisely machined. In contrast, the first embodiment of the present invention is designed such that the surfaces of each part that require precision machining are minimized by separately configuring the cutoff part 310 and the pressure piston 350. This consequently leads to an advantage in that it becomes easy to precisely machine the parts.

In the meantime, the cutoff part 310 includes a spindle 320 which is forced in the upward direction under the pressure of fuel that fills the lower pressure chamber 231 and a cutoff needle 330 which is disposed under the spindle 320 so as to be separate from the spindle 320. The cutoff needle 330 is forced in the upward direction under the pressure of fuel that fills the cutoff pressure chamber 232, and when actuated upward together with the spindle 320, opens the first flow path 220.

Since the cutoff part 310 is configured such that the spindle 320 and the cutoff needle 330 are separate from each other, the surfaces of each part that require precision machining are designed to be minimized as in the case in which the cutoff part 310 and the pressure piston 350 are configured separate from each other, thereby leading to a design advantage of facilitating precise machining of the parts.

In the meantime, the control chamber 233 and the control orifice 234 are formed such that they are connected to the lower pressure chamber 231 to discharge fuel inside the lower pressure chamber 231 out of the valve body 200 when the spindle is actuated in the upward direction. In contrast, when the spindle 320 is not actuated, the control chamber 233 and the control orifice 234 are disconnected from the lower pressure chamber 231 so that fuel is not discharged.

In addition, the valve body 200 also has a fuel drain hole 235 which prevents fuel in the cutoff pressure chamber 232 from leaking to the lower pressure chamber 231 through the interval between the outer circumference of the cutoff needle 330 and the inner circumference of the valve body 200 so that the pressure of leaking fuel does not additionally act on the spindle 320.

The fuel drain hole 235 is formed such that it is positioned at a contact area between the spindle 320 and the cutoff needle 330, whereby fuel can more easily drain from the cutoff pressure chamber 232.

In addition, the nozzle pressing part 400 includes a needle spindle 410 and a nozzle spring 420. The needle spindle 410 has a concave chamber 411 in the upper portion thereof which can be filled with fuel when the first flow path 220 is opened by the cutoff part 310 of the injection controller 300. The needle spindle 410 is disposed above the needle 520, and applies a downward force to the needle 520 under the pressure of fuel. The nozzle spring 420 is disposed above the needle spindle 410, and applies a downward force to the needle spindle 410.

In addition, pressure acting surfaces 333 having a stepped shape are formed on the spindle 320 and the cutoff needle 330 such that a driving force can act in the upward direction in response to the pressure of fuel that fills the lower pressure chamber 231 and the cutoff pressure chamber 232.

A description will be given of the operating state of the fuel injection valve having the above-described configuration according to the first embodiment of the present invention.

First, when fuel is not injected, high-pressure fuel supplied through the fuel supply port 210 fills the cutoff pressure chamber 232 through the upper pressure chamber 230 which is formed above the injection controller 300, i.e. above the pressure piston 350, and the first flow path 220.

During the standby period in which fuel is not injected as such, fuel is not delivered to the lower pressure chamber 231 through the second flow path 221, since the control needle 240 stays closing the second flow path 221.

Accordingly, the cutoff part 310 stays closed since the total of a force that acts in the downward direction on the upper portion of the pressure piston 350, which is under the pressure of fuel that has filled the upper pressure chamber 230, and a force from the spring 340 that acts in the downward direction is greater than a force that acts in the upward direction on the cutoff part 310 through the cutoff pressure chamber 232.

As the first flow path 220 is closed by the cutoff part 310 in this way, and high-pressure fuel is not delivered to the nozzle part 500, the needle 520 also stays closed under the force of the nozzle spring 420 that acts in the downward direction, whereby fuel is not injected through the nozzle hole 530.

When starting fuel injection, as the actuator operates in response to a control signal to lift up the control needle 240, the second flow path 221 which has been closed by the control needle 240 is opened, thereby allowing high-pressure fuel to be delivered to the lower pressure chamber 231. The pressure of fuel that fills the lower pressure chamber 231 acts on the pressure acting surface 333 formed on the spindle 320 of the cutoff part 310.

Accordingly, as the force caused by the pressure of fuel that acts in the upward direction on the spindle 320 and the cutoff needle 330 of the cutoff part 310 becomes greater than the total of the force that acts on the upper portion of the pressure piston 350 under the pressure of fuel that has filled the upper pressure chamber 230 and the force from the spring 340 that acts in the downward direction, the cutoff needle 330 is lifted up, thereby opening the first flow path 220, whereby high-pressure fuel is delivered to the chamber 411 defined above the needle spindle 410 and to the nozzle chamber 510 of the nozzle part 500.

When the force that lifts up the needle of the nozzle part 500, under the pressure of fuel that has been delivered to the nozzle chamber 510, exceeds the total of the force acting in the downward direction that is caused by fuel that has filled the chamber 411 in the upper portion of the needle spindle 410 and the force acting in the downward direction on the needle spindle 410 that is caused by the nozzle spring 420, the needle 520 of the nozzle part 500 is lifted up, and fuel is injected through the nozzle hole 530.

Here, the pressure of opening the nozzle is determined by the force acting on the upper portion of the needle spindle 410 caused by the pressure of fuel that fills the chamber 411 formed in the upper portion of the needle spindle 410 and the force of the nozzle spring 420. In this case, it is possible to reduce the load of the nozzle spring 420 more than in the case of pressing the needle 520 of the nozzle part 500 using only the nozzle spring 420. Accordingly, it is easy to reduce the size of the nozzle spring 420 or increase the pressure for opening the nozzle part 500.

When completing fuel injection, the control needle 240 moves downward in response to a control signal, thereby closing the second path 221.

When the second flow path 221 is closed as such, fuel is no longer supplied to the lower pressure chamber 231 but is discharged through control orifice 234 so that the pressure inside the lower pressure chamber 231 decreases.

Consequently, the force for lifting up the spindle 320 and the cutoff needle 330, caused by the pressure of fuel that fills the cutoff pressure chamber 232, becomes smaller than the total of the force acting on the upper portion of the pressure piston 350 caused by the pressure of fuel that fills the upper pressure chamber 230 and the force from the spring 340 for pressing the cutoff needle 330.

Consequently, the cutoff needle 330 moves down to close the first flow path 220, so that high-pressure fuel is no longer delivered to neither the chamber 411 formed in the upper portion of the needle spindle 410 nor the nozzle chamber 510 of the nozzle part 500 through the first flow path 220.

In addition, after the cutoff needle 330 is closed as above, fuel that has remained in the first flow path 220 is injected toward the nozzle hole 530 of the nozzle part 500. This consequently decreases the pressure in the nozzle chamber 510, thereby decreasing the force needed for lifting up the needle 520 of the nozzle part 500. When this force becomes smaller than the total of the force acting on the upper portion of the needle spindle 410 caused by fuel that has filled the chamber 411 in the upper portion of the needle spindle 410 and the force caused by the nozzle spring 420, the needle 520 of the nozzle part 500 moves downward to close the flow path to the nozzle hole 530, thereby completing fuel injection.

In the fuel injection valve according to the first embodiment of the present invention as described above, the control needle 240 can operate in response to a control signal to control the time to inject fuel and the amount of fuel to be injected independently from the operating condition of an engine, unlike the traditional mechanical fuel injection valve.

In addition, since a control method for fuel injection increases the force of lifting up the cutoff needle 330 of the injection controller 300 by delivering high-pressure fuel to the lower pressure chamber 231 via the control needle 240, control over fuel injection is rapid.

Furthermore, parts can be easily assembled and replaced due to the simple structure. In particular, there is an advantage in the design in that the nozzle part 500 can be easily replaced.

In addition, there is a safety function of closing the cutoff needle 330 to cut off the first flow path 220 so that fuel is not delivered to the nozzle part 500, thereby preventing the nozzle part 550 from being under constant high pressure when fuel injection is not being injected. This function also prevents a large amount of fuel from leaking into a combustion chamber when accidents, such as damage to the needle 520 of the nozzle part 500 or to a valve seat, occur.

Furthermore, since the pressure at which the nozzle part 500 is opened is determined by the force caused by the pressure acting on the upper portion of the needle spindle 410 and the force from the nozzle spring 420, the force of the nozzle spring 420 can be reduced more than in the case in which the needle 520 of the nozzle part 500 is pressed using only the nozzle spring 420, thereby leading to a design advantage in that the size of the nozzle spring 420 can be reduced. It is also easy to increase the pressure at which the nozzle part 500 is opened or closed.

Figure 8:
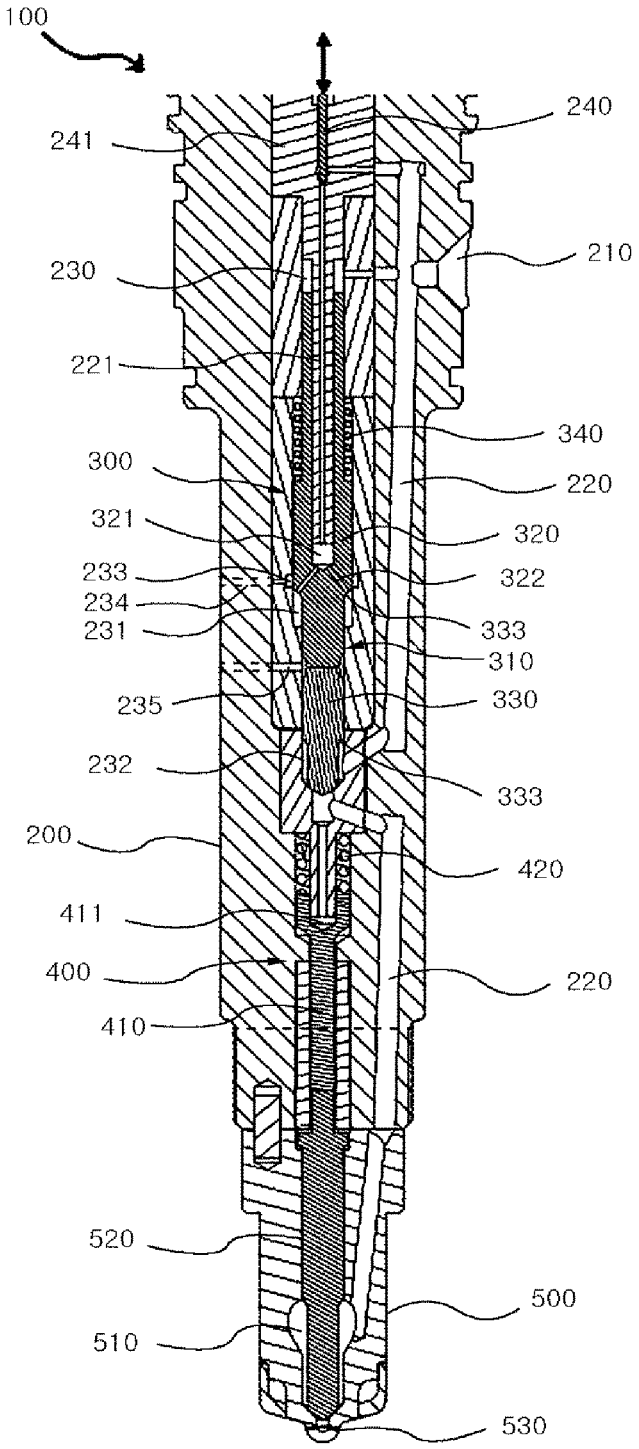
FIG. 8 is an example view showing a fuel injection valve according to a second embodiment of the present invention.
Figure 9:
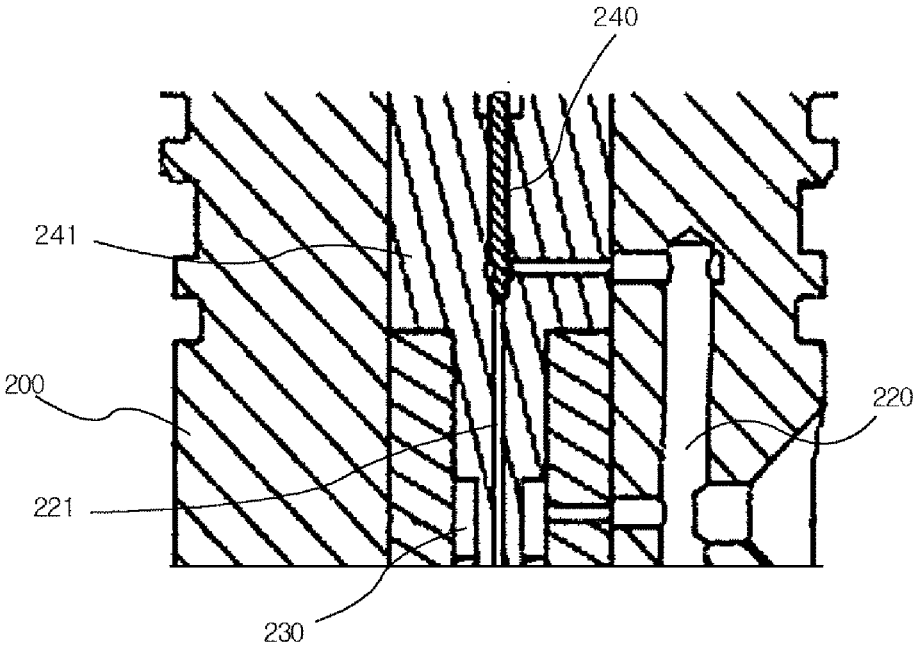
FIG. 9 is an example view specifically showing the installation structure of the control needle of the fuel injection valve according to the second embodiment of the present invention.
Figure 10:
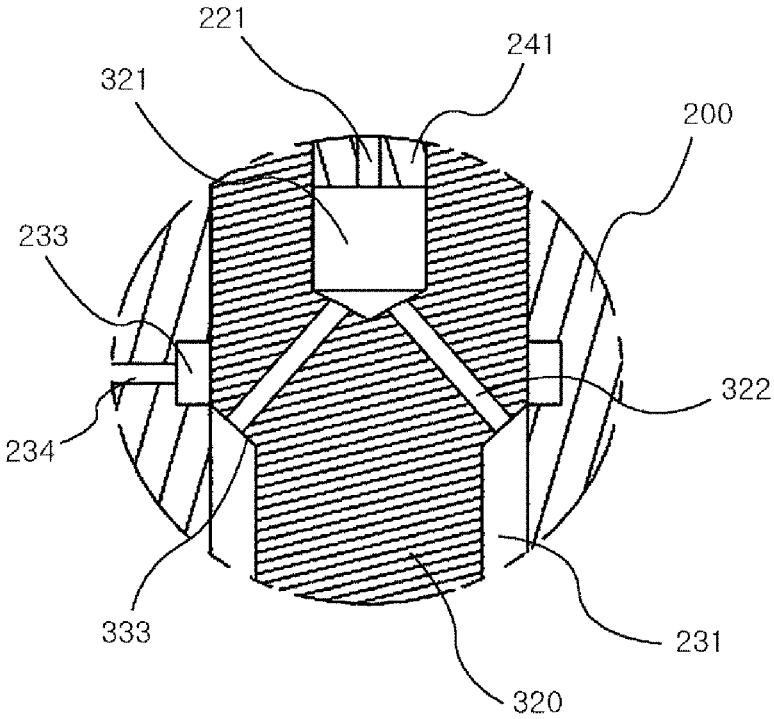
FIG. 10 is an example view specifically showing the structure of the spindle and the lower pressure chamber of the fuel injection valve according to the second embodiment of the present invention.
Figure 11:
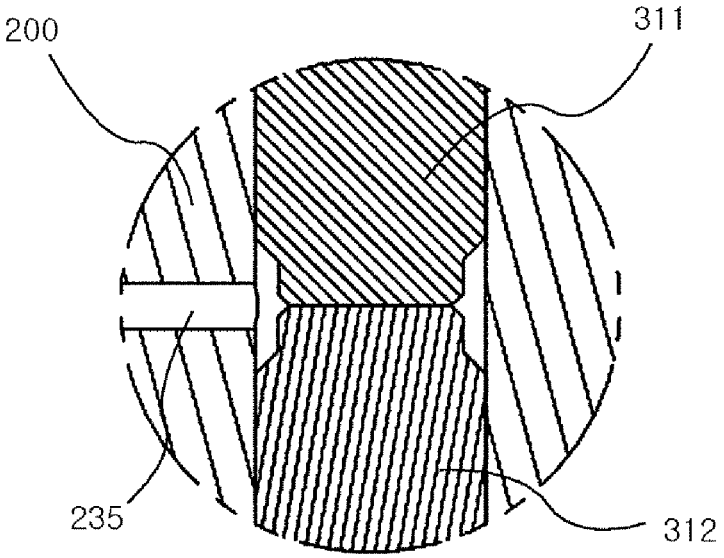
FIG. 11 is an example view showing the fuel drain hole which is formed in the contact area between the spindle and the cutoff needle of the cutoff part according to the second embodiment of the present invention.
Figure 12:
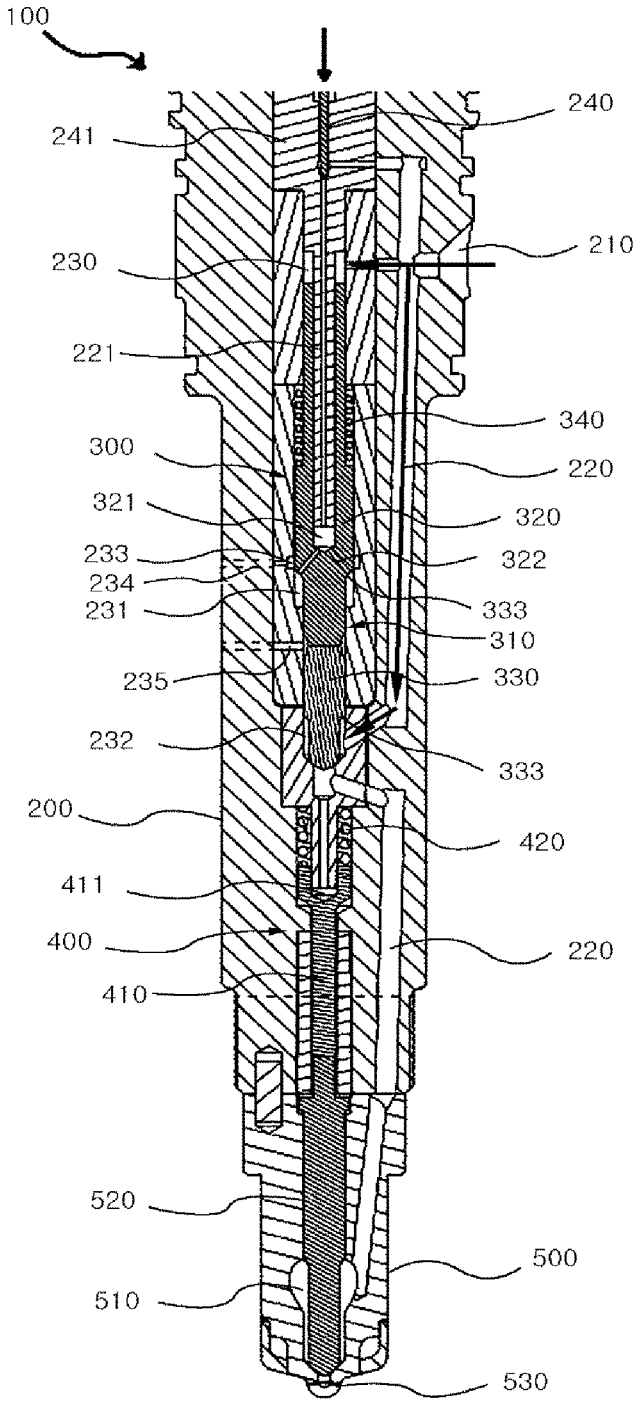
FIG. 12 is an example view showing the operating state and the flow of fuel when fuel is not injected in response to closing of the control needle of the fuel injection valve according to the second embodiment of the present invention.
Figure 13:
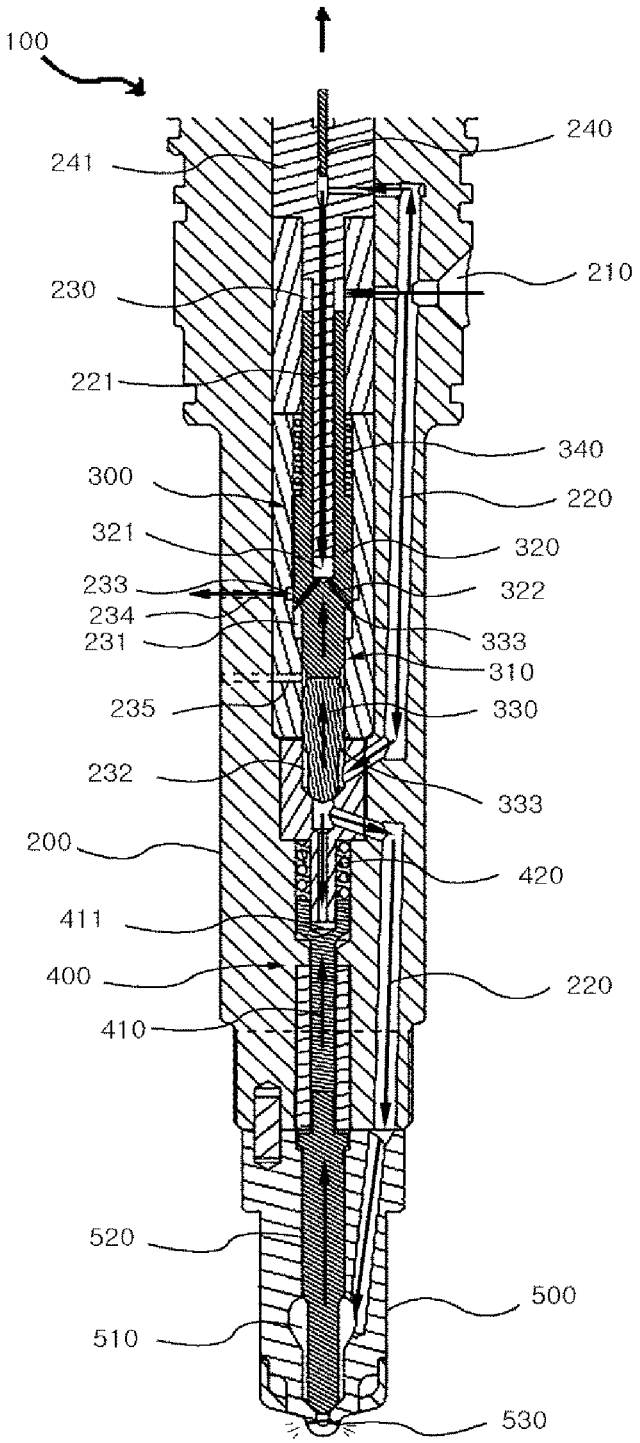
FIG. 13 is an example view showing the operating state and the flow of fuel when fuel is injected in response to opening of the control needle of the fuel injection valve according to the second embodiment of the present invention.
Figure 14:
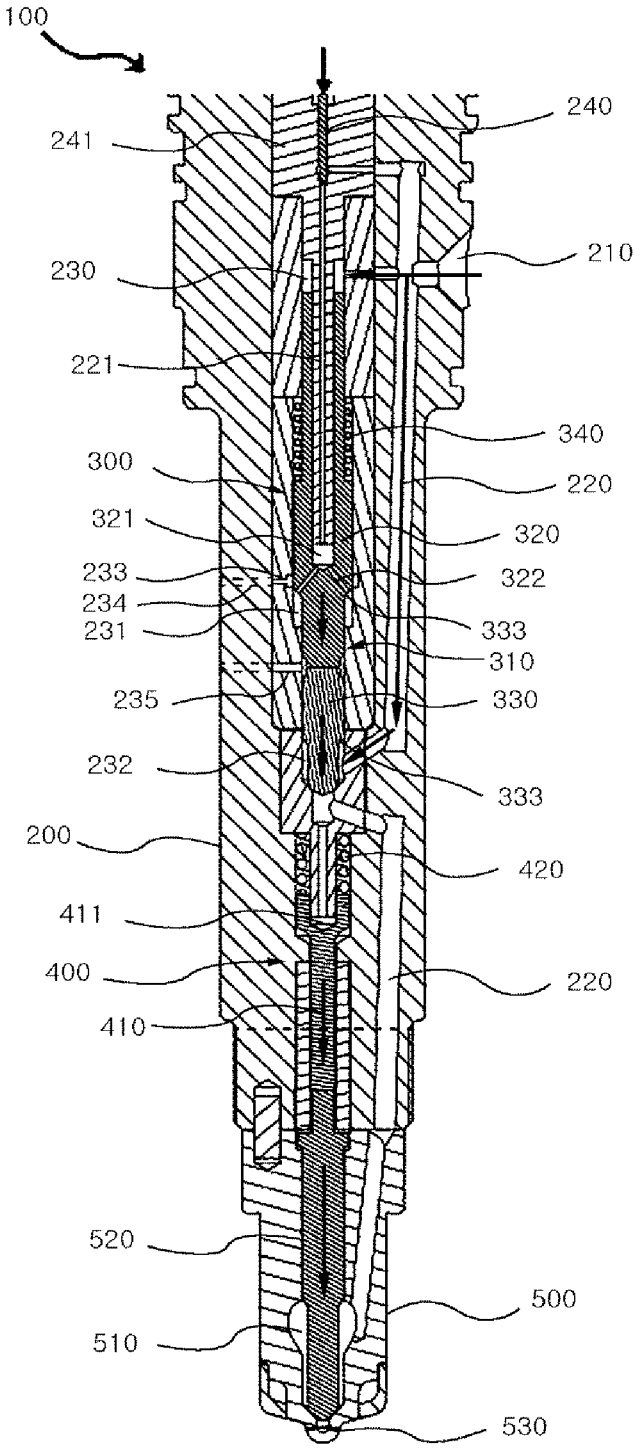
FIG. 14 is an example view showing the operating state and the flow of fuel when fuel injection is completed in response to re-closing of the control needle of the fuel injection valve according to the second embodiment of the present invention.

FIG. 8 is an example view showing a fuel injection valve according to a second embodiment of the present invention, FIG. 9 is an example view specifically showing the installation structure of the control needle of the fuel injection valve according to the second embodiment of the present invention, FIG. 10 is an example view specifically showing the structure of the spindle and the lower pressure chamber of the fuel injection valve according to the second embodiment of the present invention, FIG. 11 is an example view showing the fuel drain hole which is formed in the contact area between the spindle and the cutoff needle of the cutoff part according to the second embodiment of the present invention, FIG. 12 is an example view showing the operating state and the flow of fuel when fuel is not injected in response to closing of the control needle of the fuel injection valve according to the second embodiment of the present invention, FIG. 13 is an example view showing the operating state and the flow of fuel when fuel is injected in response to opening of the control needle of the fuel injection valve according to the second embodiment of the present invention, and FIG. 14 is an example view showing the operating state and the flow of fuel when fuel injection is completed in response to re-closing of the control needle of the fuel injection valve according to the second embodiment of the present invention.

As shown in the figures, according to the second embodiment of the present invention, the fuel injection valve 100 includes a valve body 200, a nozzle part 500, an injection controller 300, a nozzle pressing part 400, an upper pressure chamber 230, a lower pressure chamber 231, a cutoff pressure chamber 232, a second flow path 221, a control needle 240, a control chamber 233 and a control orifice 234. The valve body 200 has defined therein a first flow path 220 along which fuel is fed through a fuel supply port 210, and has a control valve housing 241 in the upper portion thereof. The nozzle part 500 is coupled to the lower portion of the valve body 200, and has defined therein a nozzle chamber 510 which is filled with fuel that is supplied via the first flow path 220 so that a needle 520 disposed therein is pressed upward, whereby the needle 520 is lifted up so that fuel is injected toward a nozzle hole 530. The injection controller 300 is disposed inside the valve body 200 such that it can open and close the first flow path 220 in order to control the nozzle part 500 to inject fuel. The nozzle pressing part 400 is disposed inside the valve body 200, is positioned below the injection controller 300, and applies a downward force to the needle 520 of the nozzle part 500. The upper pressure chamber 230 is formed above the injection controller 300, and creates a pressure when it is filled with fuel fed through the fuel supply port 210, the pressure moving the injection controller 300 downward. The lower pressure chamber 231 is positioned below the upper pressure chamber 230, and creates a pressure when it is filled up with fuel, the pressure lifting up the injection controller 300. The cutoff pressure chamber 232 is positioned below the lower pressure chamber 231, and creates a pressure when it is filled with fuel that flows through the first flow path 220, the pressure lifting up the injection controller 300. The second flow path 221 is formed inside the injection controller 300 via the control valve housing 241, and is connected to the lower pressure chamber 231. The injection controller 300 allows fuel to be supplied to the lower pressure chamber 231. The control needle 240 is disposed within the control valve housing 241, and opens and closes the second flow path 221 in response to a control signal, thereby controlling the flow rate of fuel that is supplied to the lower pressure chamber 231. The control chamber 233 is formed in the valve body 200 so as to be connected to the lower pressure chamber 231, such that it is filled with fuel from the lower pressure chamber 231 when fuel is discharged. The control orifice 234 is connected to the control chamber 233, and allows fuel inside the control chamber 233 to be discharged out of the valve body 200.

The control needle 240 is configured such that it can be actuated by an actuator (not shown) which operates in response to a control signal so as to open and close the second flow path 221, thereby controlling the flow rate of fuel that flows into the lower pressure chamber 231.

The injection controller 300 includes a cutoff part 310 and a spring 340. The cutoff part 310 is disposed such that it is fitted into the control valve housing 241, and is positioned below the upper pressure chamber 230. The cutoff part 310 is lifted up by a force caused by the pressure of fuel that fills the lower pressure chamber 231 and the cutoff pressure chamber 232, thereby opening and closing the cutoff part 310. The spring 340 is disposed such that it is fitted into the cutoff part 310, and applies a downward force to the cutoff part 310.

The cutoff part 310 includes a spindle 320 and a cutoff needle 330. The spindle 320 has an insertion hole 321 into which the control valve housing 241 can be inserted and a plurality of connection holes 322 inside the insertion hole 321, the connecting holes 322 being connected to the lower pressure chamber 231 such that the second flow path 221 formed in the control valve housing 241 can be connected to the lower pressure chamber 231. The spindle 320 is forced in the upward direction under the pressure of fuel that fills the lower pressure chamber 231. The cutoff needle 330 is disposed under the spindle 320 so as to be separate from the spindle 320. The cutoff needle 330 is forced in the upward direction under the pressure of fuel that fills the cutoff pressure chamber 232, and when actuated upward together with the spindle 320, opens the first flow path 220.

In the second embodiment of the present invention as described above, the second flow path 221 is formed in the control valve housing 241, and the control valve housing 241 is inserted into the insertion hole 321 of the spindle 320. Accordingly, the second flow path 221 is positioned inside the spindle 320.

Since the second flow path is formed in the control valve housing 241 as above, the structure of the second flow path 221 is simplified, and the second flow path 221 can be more easily machined than in the case where the flow path is formed in the valve body 200.

In addition, since the spindle 320 and the cutoff needle 330 of the cutoff part 310 are configured separate from each other, it is easy to adjust the intervals from the outer circumferences of the spindle 320 and the cutoff needle 330 which require precision machining to the inner circumference of the inner space of the valve body 200 in which they are disposed, thereby facilitating the fabrication of the valve and reducing fabrication cost.

That is, the intervals from the outer circumferences of the pressure piston 350 and the cutoff part 310 to the inner circumference of the inner space of the valve body 200 must be precisely machined to a very small size in order to prevent high-pressure fuel, that is to be filled inside the upper pressure chamber 230 and the lower pressure chamber 231, from leaking through the interval. When the spindle 320 and the cutoff needle 330 are formed integrally, machining is difficult since one part has a large number of surfaces that must be precisely machined. In contrast, the present invention is designed such that the surfaces of each part that require precision machining are minimized by separately configuring the spindle 320 and the cutoff needle 330. This consequently leads to an advantage of facilitating precise machining of the parts.

In the meantime, the control chamber 233 and the control orifice 234 are formed such that they are connected to the lower pressure chamber 231 to discharge fuel inside the lower pressure chamber 231 out of the valve body 200 when the spindle is actuated in the upward direction. In contrast, when the spindle 320 is not actuated, the control chamber 233 and the control orifice 234 are disconnected from the lower pressure chamber 231 so that fuel is not discharged.

In addition, the valve body 200 also has a fuel drain hole 235 which prevents fuel in the cutoff pressure chamber 232 from leaking to the lower pressure chamber 231 through the interval between the outer circumference of the cutoff needle 330 and the inner circumference of the valve body 200 so that the pressure of leaking fuel does not additionally act on the spindle 320.

The fuel drain hole 235 is formed such that it is positioned at a contact area between the spindle 320 and the cutoff needle 330, whereby fuel can more easily drain from the cutoff pressure chamber 232.

In addition, the nozzle pressing part 400 includes a needle spindle 410 and a nozzle spring 420. The needle spindle 410 has a concave chamber 411 in the upper portion thereof which can be filled with fuel when the first flow path 220 is opened by the cutoff part 310 of the injection controller 300. The needle spindle 410 is disposed above the needle 520, and applies a downward force to the needle 520 under the pressure of fuel. The nozzle spring 420 is disposed above the needle spindle 410, and applies a downward force to the needle spindle 410.

In addition, pressure acting surfaces 333 having a stepped shape are formed on the spindle 320 and the cutoff needle 330 such that a driving force can act in the upward direction in response to the pressure of fuel that fills the lower pressure chamber 231 and the cutoff pressure chamber 232.

A description will be given of the operating state of the fuel injection valve having the above-described configuration according to the second embodiment of the present invention.

First, when fuel is not injected, high-pressure fuel supplied through the fuel supply port 210 fills the cutoff pressure chamber 232 through the upper pressure chamber 230 which is formed above the injection controller 300, i.e. above the pressure piston 350, and the first flow path 220.

During the standby period in which fuel is not injected as such, fuel is not delivered to the lower pressure chamber 231 through the second flow path 221, since the control needle 240 stays closing the second flow path 221.

Accordingly, the cutoff part 310 stays closed since the total of a force that acts in the downward direction on the upper portion of the spindle 320, which is under the pressure of fuel that has filled the upper pressure chamber 230, and a force from the spring 340 that acts in the downward direction is greater than a force that acts in the upward direction on the cutoff part 310 through the cutoff pressure chamber 232.

As the first flow path 220 is closed by the cutoff part 310 and high-pressure fuel is not delivered to the nozzle part 500, the needle 520 also stays closed under the force of the nozzle spring 420 that acts in the downward direction, whereby fuel is not injected through the nozzle hole 530.

When starting fuel injection, as the actuator operates in response to a control signal to lift up the control needle 240, the second flow path 221 which has been closed by the control needle 240 is opened, thereby allowing high-pressure fuel to be delivered to the lower pressure chamber 231 through the second flow path 221 defined in the control valve housing 241 and through the connection holes 322 inside the spindle 320.

The pressure of fuel that fills the lower pressure chamber 231 acts on the pressure acting surface 333 of the spindle 320.

Accordingly, as the force caused by the pressure of fuel that acts in the upward direction on the spindle 320 and the cutoff needle 330 of the cutoff part 310 through the cutoff chamber 232 and the lower pressure chamber 231 becomes greater than the total of the force that acts on the upper portion of the spindle 320 under the pressure of fuel that has filled the upper pressure chamber 230 and the force from the spring 340 that acts in the downward direction, the cutoff needle 330 is lifted up, thereby opening the first flow path 220, whereby high-pressure fuel is delivered to the chamber 411 defined above the needle spindle 410 and to the nozzle chamber 510 of the nozzle part 500.

When the force that lifts up the needle 520 of the nozzle part 500 under the pressure of fuel that has been delivered to the nozzle chamber 510 exceeds the total of the force acting in the downward direction that is caused by fuel that has filled the chamber 411 in the upper portion of the needle spindle 410 and the force acting in the downward direction on the needle spindle 410 that is caused by the nozzle spring 420, the needle 520 of the nozzle part 500 is lifted up, and fuel is injected through the nozzle hole 530.

Here, the pressure of opening the nozzle is determined by the force acting on the upper portion of the needle spindle 410 caused by the pressure of fuel that fills the chamber 411 formed in the upper portion of the needle spindle 410 and the force of the nozzle spring 420. In this case, it is possible to reduce the load of the nozzle spring 420 than in the case of pressing the needle 520 of the nozzle part 500 using only the nozzle spring 420. Accordingly, it is easy to reduce the size of the nozzle spring 420 or increase the pressure for opening the nozzle part 500.

When completing fuel injection, the control needle 240 moves downward in response to a control signal, thereby closing the second path 221.

When the second flow path 221 is closed as such, fuel is no longer supplied to the lower pressure chamber 231 but is discharged through control orifice 234, so that the pressure inside the lower pressure chamber 231 decreases.

Consequently, the force for lifting up the spindle 320 and the cutoff needle 330 caused by the pressure of fuel that fills the cutoff pressure chamber 232 becomes smaller than the total of the force acting on the upper portion of the spindle 320 caused by the pressure of fuel that fills the upper pressure chamber 230 and the force from the spring 340 for pressing the cutoff needle 330.

Consequently, the cutoff needle 330 moves down to close the first flow path 220, so that high-pressure fuel is no longer delivered to neither the chamber 411 formed in the upper portion of the needle spindle 410 nor the nozzle chamber 510 of the nozzle part 500 through the first flow path 220.

In addition, after the cutoff needle 330 is closed as above, fuel that has remained in the first flow path 220 is injected toward the nozzle hole 530 of the nozzle part 500. This consequently decreases the pressure in the nozzle chamber 510, thereby decreasing the force needed for lifting up the needle 520 of the nozzle part 500. When this force becomes smaller than the total of the force acting on the upper portion of the needle spindle 410 caused by fuel that has filled the chamber 411 in the upper portion of the needle spindle 410 and the force caused by the nozzle spring 420, the needle 520 of the nozzle part 500 moves downward to close the flow path to the nozzle hole 530, thereby completing fuel injection.

In the fuel injection valve according to the second embodiment of the present invention as above, the control needle 240 can operate in response to a control signal to control the time to inject fuel and the amount of fuel to be injected independently from the operating condition of an engine, unlike the traditional mechanical fuel injection valve.

In addition, since the second flow path 221 is formed through the control valve housing 241, it is easier than forming the second flow path 221 in the valve body 200. This consequently facilitates the fabrication of the valve.

Furthermore, since a control method for fuel injection increases the force of lifting up the cutoff needle 330 of the injection controller 300 by delivering high-pressure fuel to the lower pressure chamber 231 via the control needle 240, control over fuel injection is rapid.

In addition, parts can be easily assembled and replaced due to the simple structure. In particular, there is an advantage in the design in that the nozzle part 500 can be easily replaced.

Furthermore, there is a safety function of closing the cutoff needle 330 to cut off the first flow path 220 so that fuel is not delivered to the nozzle part 500, thereby preventing the nozzle part 550 from being under constant pressure when fuel injection is not being injected. This function also prevents a large amount of fuel from leaking into a combustion chamber when accidents, such as damage to the needle 520 of the nozzle part 500 or to a valve seat, occur.

In addition, since the pressure at which the nozzle part 500 is opened is determined by the force caused by the pressure acting on the upper portion of the needle spindle 410 and the force from the nozzle spring 420, the force of the nozzle spring 420 can be reduced than in the case in which the needle 520 of the nozzle part 500 is pressed using only the nozzle spring 420, thereby leading to an advantage in that the size of the nozzle spring 420 can be reduced. It is also easy to increase the pressure at which the nozzle part 500 is opened or closed.

Although the present invention has been described hereinabove with respect to the certain exemplary embodiments, it should be understood that the present invention is not limited to the foregoing embodiments. It is apparent to a person having ordinary skill in the art to which the present invention belongs that a variety of changes can be made without departing from the concept of the present invention that is defined in the appended claims, and that such changes fall within the scope of the claims.

What is claimed is:

1. An electronically controlled fuel injection valve comprising:

a valve body having defined therein a first flow path along which fuel is fed through a fuel supply port, the valve body having a control valve housing in an upper portion thereof;

a nozzle part coupled to a lower portion of the valve body, the nozzle part having defined therein a nozzle chamber which is filled with fuel that is supplied via the first flow path so that a needle disposed therein is pressed upward, whereby the needle is lifted up so that fuel is injected toward a nozzle hole;

an injection controller disposed inside the valve body so as to be able to open and close the first flow path in order to control the nozzle part to inject fuel;

a nozzle pressing part positioned below the injection controller, the nozzle pressing part applying a downward force to the needle of the nozzle part;

an upper pressure chamber formed above the injection controller, the upper pressure chamber creating a pressure when the upper pressure chamber is filled with fuel injected through the fuel supply port, the pressure moving the injection controller downward;

a lower pressure chamber positioned below the upper pressure chamber, the lower pressure chamber creating a pressure when the lower pressure chamber is filled up with fuel, the pressure lifting up the injection controller;

a cutoff pressure chamber positioned below the lower pressure chamber, the cutoff pressure chamber creating a pressure when the cutoff pressure chamber is filled with fuel that flows through the first flow path, the pressure lifting up the injection controller;

a second flow path formed in the valve body via the control valve housing, the second flow path being connected to the lower pressure chamber, thereby allowing fuel to be supplied to the lower pressure chamber;

a control needle disposed within the control valve housing, the control needle opening and closing the second flow path in response to a control signal, thereby controlling a flow rate of fuel that is supplied to the lower pressure chamber;

a control chamber formed in the valve body so as to be connected to the lower pressure chamber, such that the control chamber is filled with fuel from the lower pressure chamber when fuel is discharged; and a control orifice connected to the control chamber, and the control orifice allowing fuel inside the control chamber to be discharged out of the valve body.

2. The electronically controlled fuel injection valve according to claim 1, wherein the injection controller comprises:

a cutoff part disposed at a center of the valve body, the cutoff part being lifted up by a force under a pressure of fuel that fills the lower pressure chamber and the cutoff pressure chamber so as to open and close the first flow path, thereby controlling supply of fuel to the nozzle part;

a pressure piston disposed above the cutoff part, the pressure piston applying a downward force to the cutoff part under a pressure of fuel that fills the upper pressure chamber; and a spring disposed and inserted into the pressure piston, the spring applying a downward force to the cutoff part.

3. The electronically controlled fuel injection valve according to claim 2, wherein the cutoff part comprises:

a spindle forced in an upward direction under the pressure of fuel that fills the lower pressure chamber; and a cutoff needle disposed under the spindle so as to be separate from the spindle, wherein the cutoff needle is forced in an upward direction under a pressure of fuel that fills the cutoff pressure chamber, and when actuated upward together with the spindle, opens the first flow path.

4. The electronically controlled fuel injection valve according to claim 3, wherein the valve body further has a fuel drain hole which prevents fuel in the cutoff pressure chamber from leaking to the lower pressure chamber through an interval between the outer circumference of the cutoff needle and the inner circumference of the valve body so that a pressure of leaking fuel does not additionally act on the spindle.

5. The electronically controlled fuel injection valve according to claim 1, wherein the nozzle pressing part comprises:

a needle spindle having a concave chamber in an upper portion thereof which is filled with fuel when the first flow path is opened by the injection controller, the needle spindle being disposed above the needle, and applying a downward force to the needle under a pressure of fuel; and a nozzle spring disposed above the needle spindle, the nozzle spring applying a downward force to the needle spindle.

* * * * *